US006456937B1

(12) United States Patent
Doner et al.

(10) Patent No.: US 6,456,937 B1
(45) Date of Patent: Sep. 24, 2002

(54) METHODS AND APPARATUS FOR LOCOMOTIVE TRACKING

(75) Inventors: John R. Doner, Melbourne, FL (US); David L. Diana, Melbourne, FL (US); Kevin N. Clyne, W. Melbourne, FL (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/475,589

(22) Filed: Dec. 30, 1999

(51) Int. Cl.[7] ..... G01C 21/00; G05D 1/00; B64D 11/06

(52) U.S. Cl. ..... 701/213; 701/19; 701/24; 701/25; 246/122 R; 246/124; 246/167 R; 246/187 A

(58) Field of Search ..... 701/24, 25, 19, 701/213; 246/115, 117, 122 R, 124, 167 R, 187 A

(56) References Cited

U.S. PATENT DOCUMENTS

| | | | | | |
|---|---|---|---|---|---|
| 4,602,335 | A | * | 7/1986 | Perlmutter | 701/20 |
| 5,129,605 | A | * | 7/1992 | Burns et al. | 246/5 |
| 5,570,284 | A | * | 10/1996 | Roselli et al. | 701/2 |
| 5,574,469 | A | * | 11/1996 | Hsu | 342/455 |
| 5,691,980 | A | * | 11/1997 | Welles et al. | 370/316 |
| 5,740,547 | A | * | 4/1998 | Kull et al. | 701/19 |
| 5,752,218 | A | * | 5/1998 | Harrison et al. | 701/207 |
| 5,828,979 | A | * | 10/1998 | Polivka et al. | 701/117 |
| 5,836,529 | A | | 11/1998 | Gibbs | |
| 5,902,341 | A | * | 5/1999 | Wilson | 701/19 |
| 5,969,643 | A | * | 10/1999 | Curtis | 340/988 |

FOREIGN PATENT DOCUMENTS

| | | |
|---|---|---|
| DE | 19647461 | 5/1998 |
| EP | 0747726 | 11/1996 |
| EP | 0791518 | 8/1997 |

* cited by examiner

*Primary Examiner*—Jacques H. Louis-Jacques
*Assistant Examiner*—Brian J Broadhead
(74) *Attorney, Agent, or Firm*—Carl A. Rowold; Armstrong Teasdale LLP

(57) ABSTRACT

In one aspect, the present invention relates to identifying locomotive consists within train consists, and determining the order of the locomotives within the identified locomotive consists. By identifying locomotive consists and the order of locomotives within such consists, a railroad can better manage it locomotive fleet. In one exemplary embodiment, an on-board tracking system for being mounted to each locomotive of a train includes locomotive interfaces for interfacing with other systems of the particular locomotive, and a computer coupled to receive inputs from the interface, and a GPS receiver and a satellite communicator (transceiver) coupled to the computer. Generally, the onboard tracking systems determine the absolute position of the locomotive on which it is mounted and additionally, obtain information regarding specific locomotive interfaces that relate to the operational state of the locomotive. Each equipped locomotive operating in the field determines its absolute position and obtains other information independently of other equipped locomotives. Position is represented as a geodetic position, i.e., latitude and longitude. As locomotives provide location and discrete information from the field, a central data processing facility receives the raw locomotive data. The data center processes the locomotive data and determines locomotive consists.

11 Claims, 5 Drawing Sheets

METHODS AND APPARATUS FOR LOCOMOTIVE TRACKING

BACKGROUND OF THE INVENTION

This invention relates generally to locomotive management, and more specifically, to tracking locomotives and determining the specific locomotives in a locomotive consist, which includes determining order and orientation of the locomotives.

For extended periods of time, e.g., 24 hours or more, locomotives of a locomotive fleet of a railroad are not necessarily accounted for due, for example, to the many different locations in which the locomotives may be located and the availability of tracking device at those locations. In addition, some railroads rely on wayside automatic equipment identification (AEI) devices to provide position and orientation of a locomotive fleet. AEI devices typically are located around major yards and provide minimal position data. AEI devices are expensive and the maintenance costs associated with the existing devices is high. There exists a need for cost-effective tracking of locomotives.

BRIEF SUMMARY OF THE INVENTION

In one aspect, the present invention relates to identifying locomotive consists within train consists, and determining the order and orientation of the locomotives within the identified locomotive consists. By identifying locomotive consists and the order and orientation of locomotives within such consists, a railroad can better manage it locomotive fleet.

In one exemplary embodiment, an on-board tracking system for being mounted to each locomotive of a train includes locomotive interfaces for interfacing with other systems of the particular locomotive, a computer coupled to receive inputs from the interface, and a GPS receiver and a satellite communicator (transceiver) coupled to the computer. A radome is mounted on the roof of the locomotive and houses the satellite transmit/receive antennas coupled to the satellite communicator and an active GPS antenna coupled to the GPS receiver.

Generally, the onboard tracking system determines the absolute position of the locomotive on which it is mounted and additionally, obtains information regarding specific locomotive interfaces that relate to the operational state of the locomotive. Each equipped locomotive operating in the field determines its absolute position and obtains other information independently of other equipped locomotives. Position is represented as a geodetic position, i.e., latitude and longitude.

The locomotive interface data is typically referred to as "locomotive discretes" and are key pieces of information utilized during the determination of locomotive consists. In an exemplary embodiment, three (3) locomotive discretes are collected from each locomotive. These discretes are reverser handle position, trainlines eight (8) and nine (9), and online/isolate switch position. Reverser handle position is reported as "centered" or "forward/reverse". A locomotive reporting a centered reverser handle is in "neutral" and is either idle or in a locomotive consist as a trailing unit. A locomotive that reports a forward/reverse position is "in-gear" and most likely either a lead locomotive in a locomotive consist or a locomotive consist of one locomotive. Trainlines eight (8) and nine (9) reflect the direction of travel with respect to short-hood forward versus long-hood forward for locomotives that have their reverser handle in a forward or reverse position.

The online/isolate switch discrete indicates the consist "mode" of a locomotive during railroad operations. The online switch position is selected for lead locomotives and trailing locomotives that will be controlled by the lead locomotive. Trailing locomotives that will not be contributing power to the locomotive consist will have their online/isolate switch set to the isolate position.

The locomotives provide location and discrete information from the field, and a data center receives the raw locomotive data. The data center processes the locomotive data and determines locomotive consists.

Specifically, and in one embodiment, the determination of locomotive consist is a three (3) step process in which 1) the locomotives in the consist are identified, 2) the order of the locomotives with respect to the lead locomotive are identified, and 3) the orientation of the locomotives in the consist are determined as to short-hood versus long hood forward.

DETAILED DESCRIPTION OF THE INVENTION

As used herein, the term "locomotive consist" means one or more locomotives physically connected together, with one locomotive designated as a lead locomotive and the others as trailing locomotives. A "train" consist means a combination of cars (freight, passenger, bulk) and at least one locomotive consist. Typically, a train is built in a terminal/yard and the locomotive consist is at the head end of the train. Occasionally, trains require additional locomotive consists within the train consist or attached to the last car in the train consist. Additional locomotive consists sometimes are required to improve train handling and/or to improve train performance due to the terrain (mountains, track curvature) in which the train will be travelling. A locomotive consist at a head-end of a train may or may not control locomotive consists within the train.

A locomotive consist is further defined by the order of the locomotives in the locomotive consist, i.e. lead locomotive, first trailing locomotive, second trailing locomotive, and the orientation of the locomotives with respect to short-hood forward versus long-hood forward. Short-hood forward refers to the orientation of the locomotive cab and the direction of travel. Most North American railroads typically require the lead locomotive to be oriented short-hood forward for safety reasons, as forward visibility of the locomotive operating crew is improved.

Figure 1:
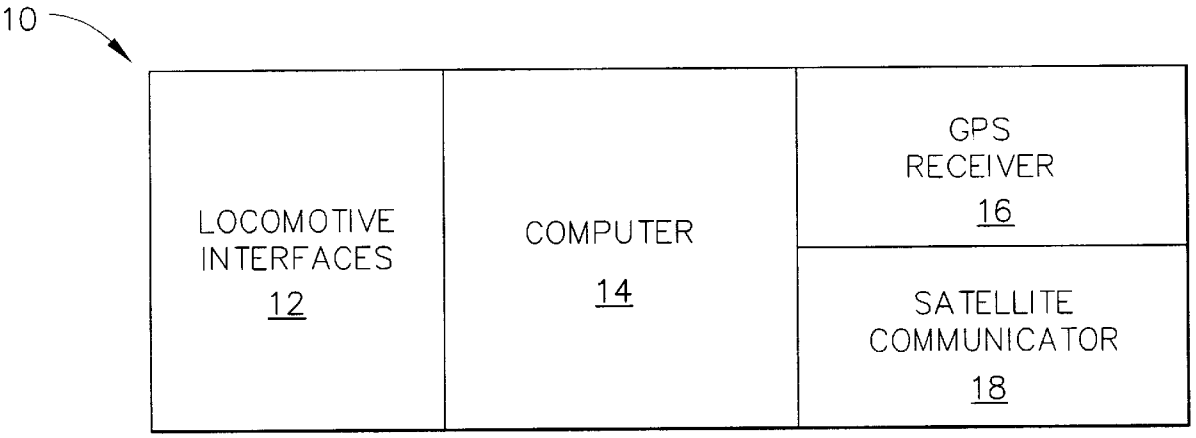
FIG. 1 is a block diagram of an on-board tracking system.

FIG. 1 is a block diagram of an on-board tracking system 10 for each locomotive and/or car of a train consist.

Although the on-board system is sometimes described herein in the context of a locomotive, it should be understood that the tracking system can be used in connection with cars as well as any other train consist member. More specifically, the present invention may be utilized in the management of locomotives, rail cars, any maintenance of way (vehicle), as well as other types of transportation vehicles, e.g., trucks, trailers, baggage cars. Also, and as explained below, each locomotive and car of a particular train consist may not necessarily have such on-board tracking system.

As shown in FIG. 1, system 10 includes locomotive interfaces 12 for interfacing with other systems of the particular locomotive on which on-board system 10 is mounted, and a computer 14 coupled to receive inputs from interface 12. System 10 also includes a GPS receiver 16 and a satellite communicator (transceiver) 18 coupled to computer 14. Of course, system 10 also includes a power supply for supplying power to components of system 10. A radome (not shown) is mounted on the roof of the locomotive and houses the satellite transmit/receive antennas coupled to satellite communicator 18 and an active GPS antenna coupled to GPS receiver 16.

Figure 2:
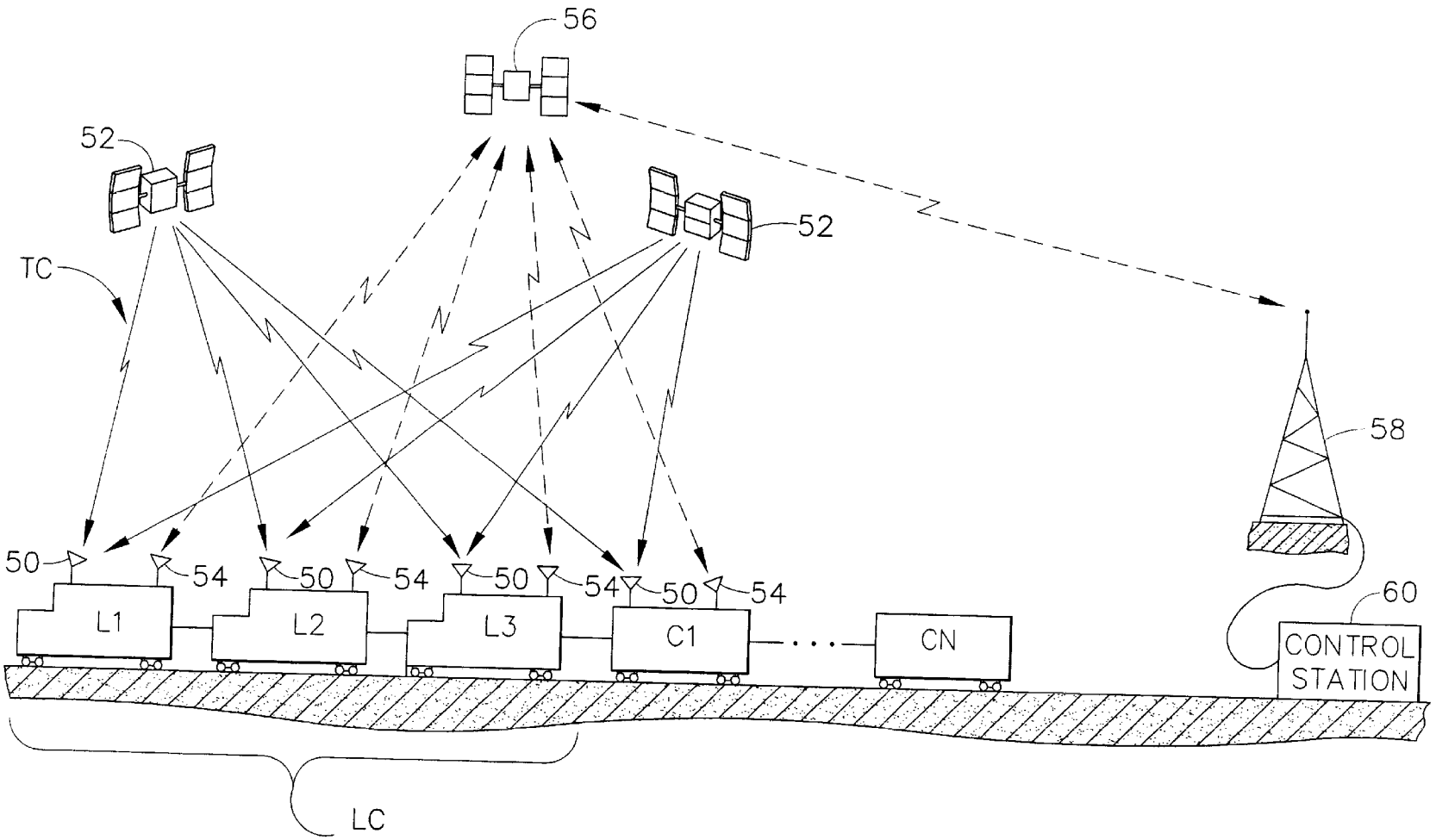
FIG. 2 illustrates a train consist including a system in accordance with one embodiment of the present invention.

FIG. 2 illustrates a locomotive consist LC which forms part of a train consist TC including multiple cars C1–CN. Each locomotive L1–L3 and car C1 includes a GPS receiver antenna 50 for receiving GPS positioning data from GPS satellites 52. Each locomotive L1–L3 and car C1 also includes a satellite transceiver 54 for exchanging, transmitting and receiving data messages with central station 60.

Generally, each onboard tracking system 10 determines the absolute position of the locomotive on which it is mounted and additionally, obtains information regarding specific locomotive interfaces that relate to the operational state of the locomotive. Each equipped locomotive operating in the field determines its absolute position and obtains other information independently of other equipped locomotives. Position is represented as a geodetic position, i.e., latitude and longitude.

The locomotive interface data is typically referred to as "locomotive discretes" and are key pieces of information utilized during the determination of locomotive consists. In an exemplary embodiment, three (3) locomotive discretes are collected from each locomotive. These discretes are reverser handle position, trainlines eight (8) and nine (9), and online/isolate switch position. Reverser handle position is reported as "centered" or "forward/reverse". A locomotive reporting a centered reverser handle is in "neutral" and is either idle or in a locomotive consist as a trailing unit. A locomotive that reports a forward/reverse position refers to a locomotive that is "in-gear" and most likely either a lead locomotive in a locomotive consist or a locomotive consist of one locomotive. Trainlines eight (8) and nine (9) reflect the direction of travel with respect to short-hood forward versus long-hood forward for locomotives that have their reverser handle in a forward or reverse position.

Trailing locomotives in a locomotive consist report the appropriate trainline information as propagated from the lead locomotive. There fore , trailing locomotives in a locomotive consist report trainline information while moving and report no trainline information while idle (not moving).

The online/isolate switch discrete indicates the consist "mode" of a locomotive during railroad operations. The online switch position is selected for lead locomotives and trailing locomotives that will be controlled by the lead locomotive. Trailing locomotives that will not be contributing power to the locomotive consist will have their online/isolate switch set to the isolate position.

As locomotives provide location and discrete information from the field, a central data processing center, e.g., central station 60, receives the raw locomotive data. Data center 60 processes the locomotive data and determines locomotive consists as described below.

Generally, each tracking system 10 polls at least one GPS satellite 52 at a Specified send and sample time. In one embodiment, a pre-defined satellite 52 is designated in memory of system 10 to determine absolute position. A data mes sage containing the p position and discrete data is then transmitted to central station 60 via satellite 56, i.e., a data satellite, utilizing transceiver 54. Typically, data satellite 56 is a different satellite than GPS satellite 52. Additionally, data is transmitted from central station 60 to each locomotive tracking system 10 via data satellite 56. Central station 60 includes at least one antenna 58, at least one processor. (not shown), and at least one satellite transceiver (not shown) for exchanging data messages with tracking systems 10.

More specifically, and i n one embodiment, the determination of locomotive consist is a three (3) step process in which 1) the locomotives in the consist are identified, 2) the order of the locomotives with respect to the lead locomotive are identified, and 3) the orientation n of the locomotives in the consist are determined as to short-hood versus long hood forward. In order to identify locomotives in a locomotive consist, accurate position data for each locomotive in the locomotive consist is necessary. Due to errors introduced into the solution provided by GPS, typical accuracy is around 100 meters. Randomly collecting location data therefore will not provide the required location accuracy necessary to determine a locomotive consist.

In one embodiment, the accuracy of the position data relative to a group of locomotives is improved by sampling (collecting) the position data from each GPS receiver of each locomotive in the consist simultaneously—at the same time. The simultaneous sampling of location data is kept in synchronization with the use of on board clocks and the GPS clock. The simultaneous sampling between multiple assets is not exclusive to GPS, and can be utilized in connection with other locations devices to such as Loran or Qualcomm's location device (satellite triangulation).

The simultaneous sampling of asset positions allows for the reduction of atmospheric noise and reduction in the U.S. government injected selective availability error (noise/injection cancellation). The reduction in error is great enough to be assured assets can be uniquely identified. This methodology allows for consist order determination while the consist is moving and differs greatly from a time averaging approach which requires the asset to have been stationary, typically for many hours, to improve GPS accuracy.

More specifically, civil users worldwide use the SPS without charge or restrictions. The SPS accuracy is intentionally degraded by the U.S. Department of Defense by the use of selective availability (SA). As a result, the SPS predictable accuracy is as follows.

100 meter horizontal accuracy, and 156 meter vertical accuracy.

Noise errors are the combined effect of PRN code noise (around 1 meter) and noise within the receiver (around 1 meter). Bias errors result from selective availability and other factors. Again, selective availability (SA) is a deliberate error introduced to degrade system performance for non-U.S. military and government users. The system clocks and ephemeris data is degraded, adding uncertainty to the pseudo-range estimates. Since the SA bias, specific for each satellite, has low frequency terms in excess of a few hours, averaging pseudo-range estimates over short periods of time is not effective. The potential accuracy of 30 meters for C/A code receivers is reduced to 100 meters.

As a result of the locomotives being very close geographically and sampling the satellites at exactly the same time, a majority of the errors are identical and are cancelled out. resulting in an accuracy of approximately 25 feet. This improved accuracy does not require additional processing nor more expensive receivers or correction schemes.

Each locomotive transmits a status message containing a location report that is time indexed to a specific sample and send time based on the known geographic point from which the locomotive originated. A locomotive originates from a location after a period in which it has not physically moved (idle). Locomotive consists are typically established in a yard/terminal after an extended idle state. Although not necessary, in order to obtain a most accurate location, a locomotive should be moving or qualified over a distance, i.e., multiple samples when moving over some minimum distance. Again, however, it is not necessary that the locomotive be moving or qualified over a distance.

Each tracking system 10 maintains a list of points known as a locomotive assignment point (LAP) which correlates to the yards/terminals in which trains are built. As a locomotive consist assigned to a train departs a locomotive assignment point (LAP), onboard system 10 determines the departure condition and sends a locomotive position message back to the data center. This message contains at a minimum, latitude, longitude and locomotive discretes.

The data for each locomotive is sampled at a same time based on a table maintained by each locomotive and the data center, which contains LAP ID, GPS sample time, and message transmission time. Therefore, the data center receives a locomotive consist message for each locomotive departing the LAP, which in most instances provides the first level of filtering for potential consist candidates. The distance at which the locomotives determine LAP departure is a configurable item maintained on-board each tracking system.

Figure 3:
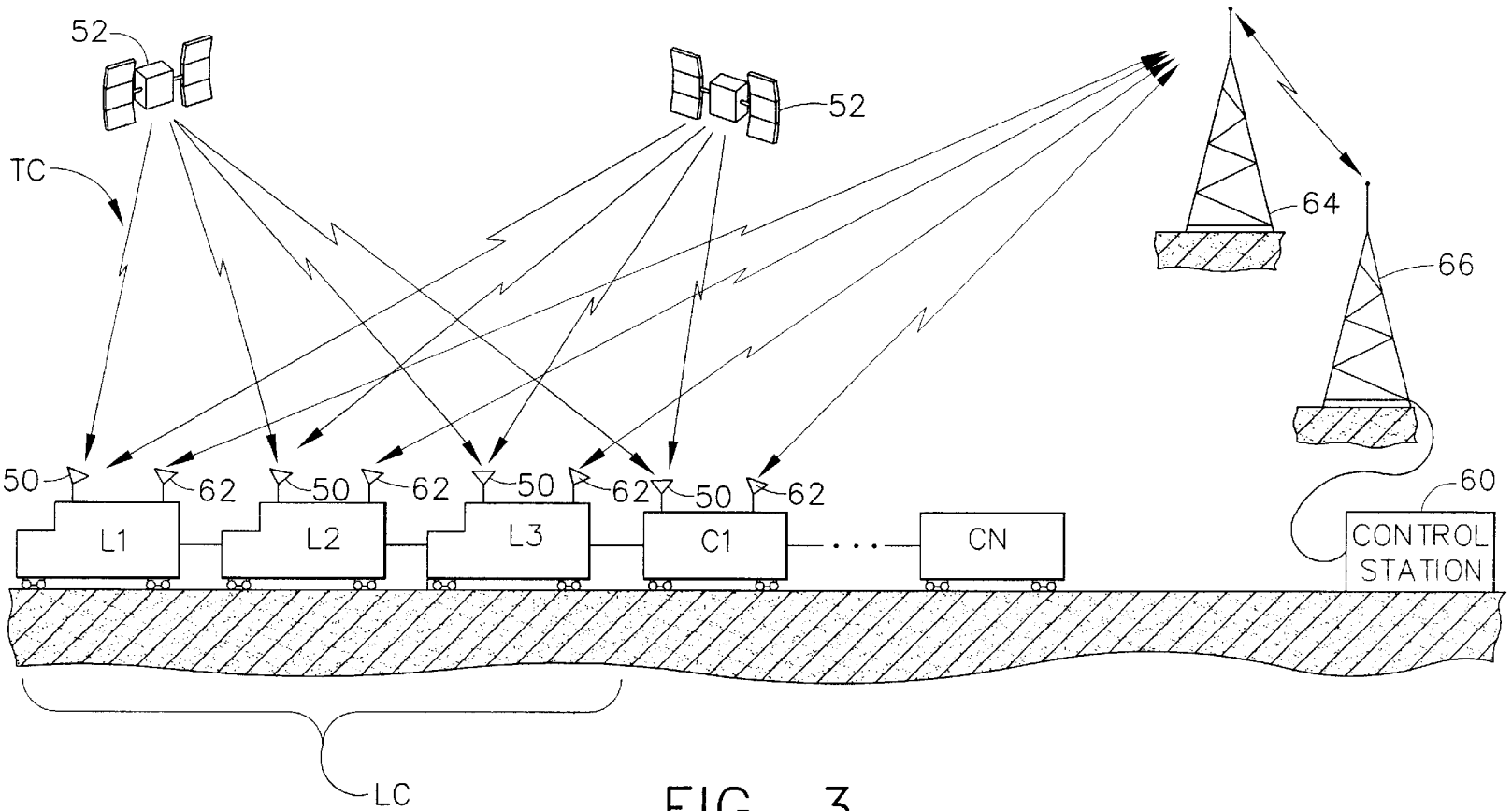
FIG. 3 illustrates a train consist including a system in accordance with another embodiment of the present invention.

FIG. 3 illustrates train consist TC including an on-board system in accordance with another embodiment of the present invention. Each locomotive L1–L3 and car C1 includes a GPS receiver antenna 50 for receiving GPS positioning data from GPS satellites 52. Each locomotive L1–L3 and car C1 also includes a radio transceiver 62 for exchanging, transmitting and receiving data messages with central station 60 via antennas 64 and 66. The on-board systems utilized in the FIG. 3 configuration are identical to on-board system 10 illustrated in FIG. 1 except that rather than a satellite communication 18, the system illustrated in FIG. 3 includes a radio communicator.

Generally, and as with system 10, each tracking system 10 polls at least one GPS satellite 52 at a specified send and sample time. In one embodiment, a pre-defined satellite 52 is designated in memory to determine absolute position. A data message containing the position and discrete data is then transmitted to central station 60 via antenna 64 utilizing transceiver 62. Additionally, data is transmitted from central station 60 to each locomotive tracking system via antenna 64. Central station 60 includes at least one antenna 66, at least one processor (not shown), and at least one satellite transceiver (not shown) for exchanging data messages with the tracking systems.

In another embodiment, each on-board system includes both a satellite communicator (FIG. 1) and a radio communicator (FIG. 3). The radio communicators are utilized so that each on-board system can exchange data with other on-board systems of the train consist. For example, rather than each locomotive separately communicating its data with central station 60 via the data satellite, the data can be accumulated by one of the on-board systems via radio communications with the other on-board systems. One transmission of all the data to the central station from a particular train consist can then be made from the on-board system that accumulates all the data. This arrangement provides the advantage of reducing the number of transmissions and therefore, reducing the operational cost of the system.

Data center 60 may also include, in yet another embodiment, a web server for enabling access to data at center 60 via the Internet. Of course, the Internet is just one example of a wide area network that could be used, and other wide area network as well as local area network configurations could be utilized. The type of data that a railroad may desire to post at a secure site accessible via the Internet includes, by way of example, locomotive identification, locomotive class (size of locomotive), tracking system number, idle time, location (city and state), fuel, milepost, and time and date transmitted. In addition, the data may be used to geographically display location of a locomotive on a map. Providing such data on a secure site accessible via the Internet enables railroad personnel to access such data at locations remote from data center 60 and without having to rely on access to specific personnel.

Figure 4:
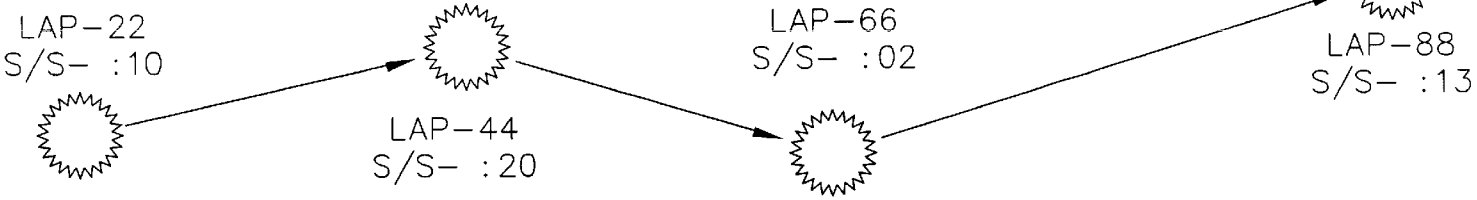
FIG. 4 illustrates a sample and send method.

FIG. 4 illustrates the above described sample and send method. For example, at LAP-22, three locomotives are idle and at some point, are applied to a train ready for departure. As the train departs the yard, each on-board system for each locomotive determines that it is no longer idle and that it is departing the LAP-22 point. Once LAP departure has been established, the on-board tracking system changes its current sample and send time to the sample and send time associated with LAP-22 as maintained onboard all tracking equipped locomotives. Based on the information in the example, the three (3) locomotives would begin sampling and sending data at ten (10) minutes after each hour.

The locomotives run-thru LAP 44 (no idle). The three locomotives therefore continue through LAP-44 on the run-thru tracks without stopping the train. The on-board systems determine entry and exit of the proximity point, but the sample and send time would remain associated with the originating LAP point (22).

The three (3) locomotives then enter LAP-66 and a proximity event would be identified. The train is scheduled to perform work in the yard which is anticipated to require nine (9) hours. During this time, the three (3) locomotives remain attached to the consist while the work is performed. After completing the assigned work, the train departs the yard (LAP-66) destined for the terminating yard (LAP-88). At this point, each on-board system determines it is no longer idle and switches its sample and send time to that specified in their table for LAP-66, i.e., at 2 minutes after each hour. At this point, the three (3) locomotives have departed LAP-66 and their sample and send time is now two (2) minutes after each hour.

At some point, the three (3) locomotives enter LAP-88 (proximity alert) and become idle for an extended period. The locomotives continue to sample and send signals based on their last origin location, which was LAP-66.

As locomotive position reports are received by the data center, the sample time associated with the reports is utilized to sort the locomotives based on geographic proximity. All locomotives that have departed specific locations will sample and send their position reports based on a lookup table maintained onboard each locomotive. The data center sorts the locomotive reports and determines localized groups of locomotives based on sample and send time.

A first step in the determination of a locomotive consist requires identification of candidate consists and lead locomotives. A lead locomotive is identified by the reverser handle discrete indicating the handle is in either the forward or reverse position. Also, the lead locomotive reports its orientation as short-hood forward as indicated by trainline discretes. Otherwise, the locomotive consist determination terminates pursuing a particular candidate locomotive consist due to the improper orientation of the lead locomotive. If a lead locomotive is identified (reverser and orientation) and all of the other locomotives in the candidate consist reported their reverser handle in the centered (neutral) position indicating trailing locomotives, the next step in the consist determination process is executed.

At this point, candidate locomotive consists have been identified based on their sample and send time and all lead locomotives have been identified based on reverser handle discretes. The next step is to associate trailing locomotives with a single lead locomotive based on geographic proximity. This is accomplished by constructing and computing the centroid of a line between each reporting locomotive and each lead locomotive. The resulting data is then filtered and those trailing locomotives with centroids that fall within a specified distance of a lead locomotive are associated with the lead as a consist member. This process continues until each reporting locomotive is either associated with a lead locomotive or is reprocessed at the next reporting cycle.

Then, the order of the locomotives in the locomotive consist is determined. The lead locomotive was previously identified, which leaves the identification of the trailing units. It should be noted that not all locomotives are equipped with on-board tracking systems and therefore, "ghost" locomotives, i.e., locomotives that are not equipped with tracking systems will not be identified at this point in time. It should also be noted that in order to identify ghost locomotives, the ghost locomotives must be positioned between tracking equipped locomotives.

Figure 5:
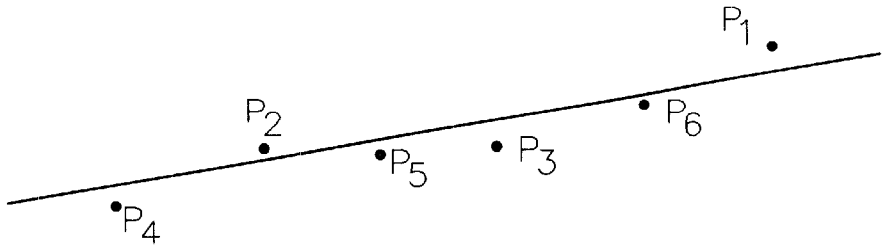
FIG. 5 illustrates apparent positions of six candidate locomotives for a locomotive consist.

FIG. 5 depicts six points in a plane which are defined by returned positional data from six locomotives in a power consist of a train. The points $P_1, \ldots, P_6$ represent the respective location of each locomotive, and since GPS positional data is not perfect, the reference line shown is taken to be the line best fitting the points (approximating the actual position of the track).

Figure 6:
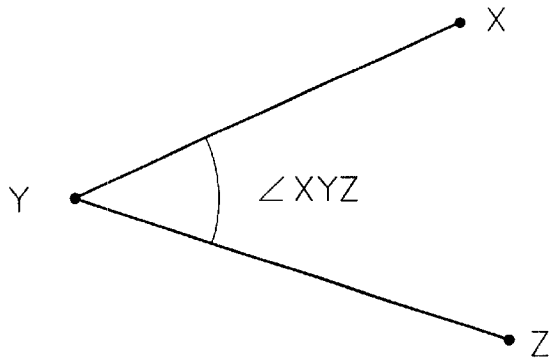
FIG. 6 illustrates an angle defined by three points.

With the notation denoting the unsigned magnitude of an angle defined on points X, Y, and Z, with Y as the vertex, as shown in FIG. 6, the angles defined by the positions of locomotives are used in order to establish their order in the locomotive consist.

Figure 7:
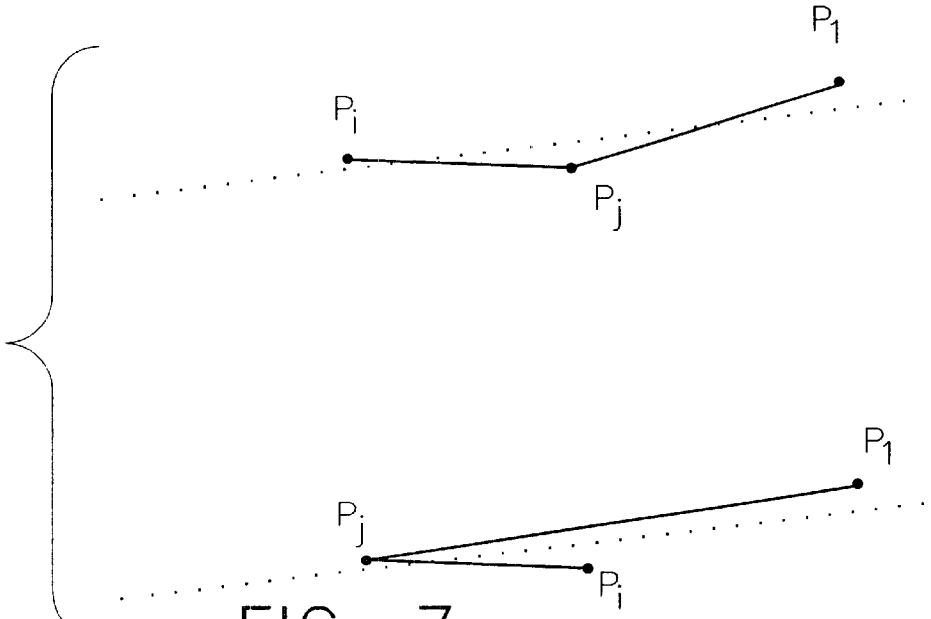
FIG. 7 illustrates using angular measure to determine locomotive order.

Referring to FIG. 7, data collection of locomotive discretes onboard the locomotive allows the determination of the position of the lead locomotive by information other than its position in the consist. Therefore, it is known that all other locomotives are behind the lead locomotive. Since the lead locomotive is identified, it is assigned the point $P_1$. For the remaining points, there is no specific knowledge of their order in the power consist, other than that they follow $P_1$. The following relationships exist.

$$\angle P_i P_j P_1 \approx 180° \rightarrow P_i \text{ follows } P_j,$$

and $$\angle P_i P_j P_1 \approx 0° \rightarrow P_i \text{ follows } P_j.$$

By forming a matrix with all rows and columns indexed by the locomotives known to be in the consist, and initially setting all entries of the matrix to zero, then a 1 is placed in any cell such that the row entry (locomotive) of the cell occurs earlier in the consist than the column entry, as determined by the angular. criterion given above. Since the lead locomotive is already known, a 1 is placed in each cell of row 1 of the matrix, except the cell corresponding to (1,1). This leads to (N−1)(N−2)/2 comparisons, where N locomotives are in the consist, since pair $(P_i, P_j)$ $i \neq j$ must be tested only once, and $P_1$ need not be included in the testing.

The matrix is shown below.

$$M = \begin{array}{c} P_1 \\ P_2 \\ P_3 \\ P_4 \\ P_5 \\ P_6 \end{array} \begin{bmatrix} 0 & 1 & 1 & 1 & 1 & 1 \\ 0 & 0 & 0 & 1 & 0 & 0 \\ 0 & 1 & 0 & 1 & 1 & 0 \\ 0 & 0 & 0 & 0 & 0 & 0 \\ 0 & 1 & 0 & 1 & 0 & 0 \\ 0 & 1 & 1 & 1 & 1 & 0 \end{bmatrix}$$

The order of the locomotives in the consist corresponds to the number of ones in each row. That is, the row with the most ones is the lead locomotive, and the locomotives then occur in the consist as follows:

$P_1$—five 1's, lead locomotive, $P_6$—four 1's, next in consist, $P_3$—three 1's next in consist, $P_5$—two 1's next in consist, $P_2$—one 1 next in consist, $P_4$—zero 1's last in consist.

The above described method does not require that all locomotives be in a single group in the train. If a train is on curved track, the angles would vary more from 0° and 180° than would be the case on straight track. However, it is extremely unlikely that a train would ever be on a track of such extreme curvature that the angular test would fail.

Another possible source of error is the error implicit in GPS positional data. However, all of the locomotives report GPS position as measured at the same times, and within a very small distance of each other. Thus, the errors in position are not be expected to influence the accuracy of the angular test by more than a few degrees, which would not lead to confusion between 0° and 180°.

Figure 8:
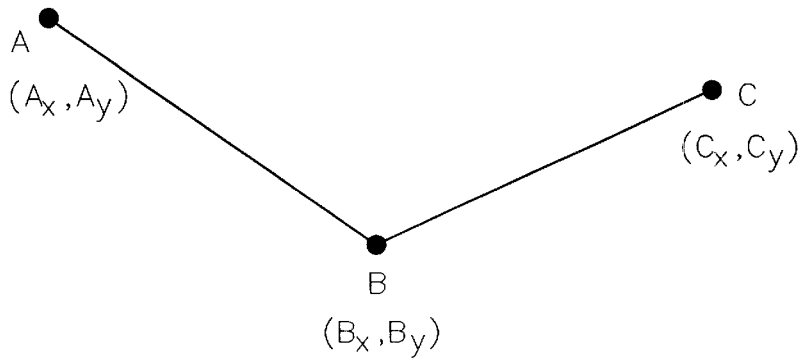
FIG. 8 illustrates coordinates of points forming an angle.

The determination of angle as described above need not actually be completely carried out. In particular, the dot product of two vectors permits quick determination of whether the angle between them in closer to 0° or 180°. FIG. 8 illustrates three points defining an angle, with coordinates determined as though the points were in Cartesian plane. Given these points and the angle indicated, the dot product may be expressed by the simple computation:

$$S=(A_x-B_x)(C_x-B_x)+(A_y-B_y)(C_yB_y).$$

The geometric interpretation of the dot product is given by:

$$S=\|AB\|\cdot\|BC\|\cdot \cos(\angle ABC),$$

where the notation ||XY|| denotes the length of a line segment between points X and Y. The lengths of line segments are always positive, so that the sign of s is determined soley by the factor cos(∠ABC), and that factor is positive for all angles within 90° of 0°, and is negative for all angles within 90° of 180°. Therefore, a test for the relative order of two locomotives can be executed by using the absolute positions of the locomotives and computing dot products for the angles shown in FIG. 6. The sign of the dot product then suffices to specify locomotive order.

Locomotive positions have been interpreted as Cartesian coordinates in a plane, while GPS positions are given in latitude, longitude, and altitude. Using the fact that a minute of arc on a longitudinal circle is approximately 1 nautical mile, and that a minute of arc on a latitudinal circle is approximately 1 nautical mile multiplied by the cosine of the latitude, one obtains an easy conversion of the (latitude, longitude) pair to a Cartesian system. Given a latitude and longitude of a point, expressed as(θ,ϕ), conversion to Cartesian coordinates is given by:

$$x=60\cdot\theta\cdot\cos(\theta),\ y=60\cdot\phi$$

This ignores the slight variations in altitude, and in effect distorts the earth's surface in a small local area into a plane, but the errors are much smaller than the magnitudes of the distances involved between locomotives, and the angular relationships between locomotives will remain correct. These errors are held to a minimum through simultaneous positioning of the multiple assets.

A last step in the determination of locomotive consist is determining the orientation of the locomotives in the consist with respect to short-hood versus long-hood forward. The data center determines the orientation by decoding the discrete data received from each locomotive. Trainlines eight (8) and nine (9) provide the direction of travel with respect to the crew cab on the locomotive. For example, a trailing locomotive traveling long-hood forward will report trainline nine (9) as energized (74 VDC), indicating the locomotive is long-hood forward. Likewise, a locomotive reporting trainline eight (8) energized (74 VDC) is assumed to be travelling short-hood forward. Utilizing the orientation of the locomotives, e.g., short hood forward (SHF) and long hood forward (LHF), railroad dispatchers are able to select a locomotive in a proper orientation to connect to a train or group of locomotives.

The above described method for determining locomotives in a locomotive consist is based on locomotives equipped with on-board tracking systems. Operationally, the presence of ghost locomotives in a locomotive consist will be very common. Even though a ghost locomotive cannot directly report through the data center, its presence is theoretically inferable provided that it is positioned between two locomotives equipped with tracking systems.

Figure 9:
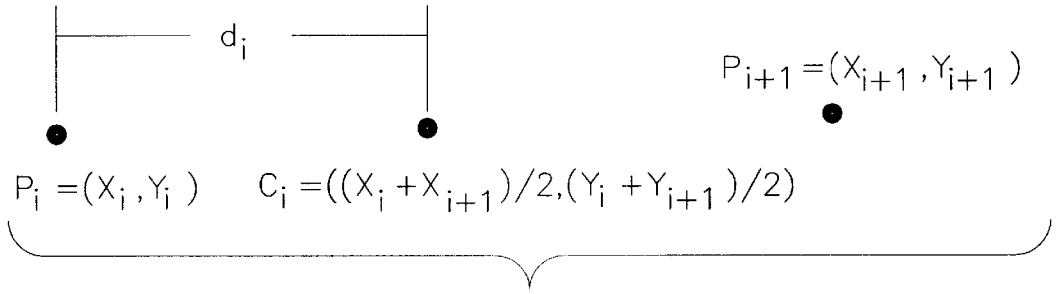
FIG. 9 illustrates location of a centroid between two locomotives.

To determine the presence of ghost locomotives between any two equipped locomotives, the order of all reporting locomotives in the locomotive consist is first determined. If there are N such locomotives at positions $P_1, P_2, \ldots, P_N$, the centroid $C_i$ of each adjacent pair of locomotives $P_i, P_{i+1}$, is determined as depicted in FIG. 9, for i=1, . . . , N−1. Then, the distance $d_i$ between the centroid $C_i$ and the locomotive position $P_i$, for i =1, . . . , N−1, is determined. The number $N_G$ of ghost locomotives in the power consist is equal to:

$$N_G = 2\sum_{i=1}^{N-1}\left(\frac{d_i}{L} - 0.5\right),$$

where ∠ is a nominal length for a locomotive. In effect, the centroid between two consecutive locomotives with on-board systems should be approximately half a locomotive length from either of the locomotives, and that distance will expand by a half-locomotive length for each interposed ghost locomotive.

Although the invention has been described and illustrated in detail, it is to be clearly understood that the same is intended by way of illustration and example only and is not to be taken by way of limitation. Accordingly the spirit and scope of the invention are to be limited only by the terms of the appended claims and their equivalents.

What is claimed is:

1. A data center comprising a computer coupled to a receiver, said computer programmed to:

collect locomotive position messages corresponding to a locomotive assignment point to determine localized groups of locomotives;

identify candidate consists and lead locomotives;

associate trailing locomotives with a single lead locomotive based on geographic proximity;

determine a centroid of a line between each reporting locomotive of a candidate consist and each lead locomotive, and associating those trailing locomotives with centroids that fall within a specified distance of a lead locomotive as a consist member; and determine an order of the locomotives in the locomotive consist.

2. A data center in accordance with claim 1 wherein identifying lead locomotives is based on a reverser handle discrete indicating whether a handle is in either a forward or reverse position.

3. A data center in accordance with claim 2 wherein identifying lead locomotives further comprises determining whether a locomotive has an orientation of short-hood forward.

4. A data center in accordance with claim 1 wherein determining an order of locomotives in the locomotive consist comprises determining whether a locomotive is oriented in at least one of short-hood forward and long hood forward.

5. A data center in accordance with claim 4 wherein determining whether a locomotive is oriented in at least one of short-hood forward and long hood forward comprises decoding locomotive discretes.

6. A method for managing locomotives, at least some locomotives having an on-board tracking system comprising a locomotive interface, a computer coupled to said locomotive interface, a GPS receiver coupled to the computer, and a communicator coupled to the computer, the computer programmed determine a position of the locomotive based on a signal received by the receiver and to transmit the position via the communicator, the computer further programmed to obtain locomotive discretes from the locomotive interface and to transmit the locomotive discretes via the communicator, said method comprising the steps of:

operating each on-board system to determine when its respective locomotive departs a locomotive assignment point, and when any of the respective locomotives depart the locomotive assignment point, operating the on-board system of each departing locomotive to determine a departure condition and to send a locomotive position message to a data center at a time corresponding to the locomotive assignment point; and at the data center, collecting locomotive position messages corresponding to the locomotive assignment point to determine localized groups of locomotives, identifying candidate consists and lead locomotives, determining a centroid of a line between each reporting locomotive of a candidate consist and each lead locomotive, and associating those trailing locomotives with centroids that fall within a specified distance of a lead locomotive as a consist member.

7. A method in accordance with claim 6 wherein identifying lead locomotives is based on a reverser handle discrete indicating whether a handle is in either a forward or reverse position.

8. A method in accordance with claim 7 wherein identifying lead locomotives further comprises the step of determining whether a locomotive has an orientation of short-hood forward.

9. A method in accordance with claim 6 further comprising the steps of associating trailing locomotives with a single lead locomotive based on geographic proximity, and determining an order of the locomotives in the locomotive consist.

10. A method in accordance with claim 9 wherein determining an order of locomotives in the locomotive consist comprises the step of determining whether a locomotive is oriented in at least one of short-hood forward and long hood forward.

11. A method in accordance with claim 10 wherein determining whether a locomotive is oriented in at least one of short-hood forward and long hood forward comprises the step of decoding locomotive discretes.

* * * * *